US005921252A

United States Patent [19]

Chubb

[11] Patent Number: 5,921,252

[45] Date of Patent: Jul. 13, 1999

[54] HAIR STYLING COMB

[76] Inventor: Gladys Chubb, 39 Chubb Dr. S.W., Cave Spring, Ga. 30124

[21] Appl. No.: 09/168,582

[22] Filed: Oct. 8, 1998

[51] Int. Cl.[6] ..... A45D 24/38; A45D 24/00

[52] U.S. Cl. ..... 132/144; 132/150; 132/219; 132/148

[58] Field of Search ..... 132/144, 145, 132/219, 126, 106, 148, 150

[56] References Cited

U.S. PATENT DOCUMENTS

| | | | |
|---|---|---|---|
| 2,156,073 | 4/1939 | Wallace et al. | 132/33 |
| 2,225,123 | 12/1940 | Madore | 132/150 |
| 2,609,822 | 9/1952 | McCormack et al. | 132/35 |
| 3,529,609 | 9/1970 | Rodriguez | 132/145 |
| 3,568,689 | 3/1971 | Piermarini | 132/150 |
| 3,646,945 | 3/1972 | Romani | 132/150 |
| 3,840,031 | 10/1974 | Walker | 132/11 R |
| 5,018,542 | 5/1991 | Lee | 132/139 |
| 5,240,017 | 8/1993 | Terwilliger | 132/145 |
| 5,558,104 | 9/1996 | Clouser | 132/144 |
| 5,626,153 | 5/1997 | Petrarea | 132/126 |

*Primary Examiner*—John J. Wilson
*Assistant Examiner*—Trang Doan
*Attorney, Agent, or Firm*—Joseph N. Breaux

[57] ABSTRACT

A hair styling comb which has a conventional comb portion and from which extends a double tang assembly, the tangs are of unequal length, are normally separated and are biased to resist movement toward one another but are slidably compressed together by a sliding compression member permanently attached to the comb. The compressible tangs are used to grip portions of hair for curling. After a curl is formed, the compression member is released and the tangs are then withdrawn from the cornroll. The device is easily constructed using plastic forming techniques and provides a useful tool for forming cornrolls or other tightly rolled curls. The double tangs are enclosed by a protective cylindrical cover when the user simply wants to use the conventional comb portion.

4 Claims, 2 Drawing Sheets

HAIR STYLING COMB

TECHNICAL FIELD

The present invention relates to devices and methods for personal grooming and more particularly to devices and methods for a hair styling comb which is specially adapted for use in making cornrolls and other tightly curled rolls in a user's hair.

BACKGROUND ART

There are numerous combs and specially adapted tools for working with human hair which are used for curling, separating, combing, braiding and plaiting hair. There are even specially adapted tools for undoing braided, plaited or cornrolled hair. These prior art devices are extremely useful for their stated purposes however, prior to the present invention there has never been a device specially adaptable for making cornrolls or tightly rolled curls. A cornroll is a stylish form of tightly rolling hair in numerous separate rolls which are in alignment.

The prior are patents which are relevant include the following: Petrarca U.S. Pat. No. 5,626,153; Clouser U.S. Pat. No. 5,558,104; Lee U.S. Pat. No. 5,018,542; Walker U.S. Pat. No. 3,840,031; Piermarini U.S. Pat. No. 3,568,689; and McCormick et al. U.S. Pat. No. 2,609,822.

The present invention is a hair styling comb which has a conventional comb portion and from which extends a double tang assembly, the tangs are of unequal length, are normally separated and are biased to resist movement toward one another but are slidably compressed together by a compression member permanently attached to the comb. The longer tang is used as a pick to separate a strand of hair at the scalp. The compressible tangs are used in combination to grip strands or portions of hair for curling. After a curl is formed, the compression member is released and the tangs are then withdrawn from the cornroll. The tangs are protected when not in use by a cylindrical cap allowing the user to utilize the conventional comb portion without interference from the tangs.

GENERAL SUMMARY DISCUSSION OF INVENTION

It is thus an object of the invention to provide a Hair Styling Comb that is particularly suitable for forming cornrolls and other tightly curled rolls.

It is a further object of the invention to provide a Hair Styling Comb that includes a combination comb and pair of tangs arranged for gripping hair and tightly rolling for the purposes of forming tightly rolled curls or cornrolls.

Accordingly a Hair Styling Comb is provided that includes a conventional comb portion and from which extends a double tang assembly, the tangs are of unequal length, are normally separated and are biased to resist movement toward one another but are slidably compressed together by a compression member permanently attached to the comb. The compressor ring slides between a raised stops positioned on the tangs and a connecting end of the tangs. A gripping end of the tangs are brought together when the compressor ring is slid towards the raised stops and are used to grip portions of hair for curling. After a curl is formed, the compressor ring is slid back to a connecting end of the tangs thereby releasing the gripping end and releasing the hair, the tangs are then withdrawn from the cornroll. The tangs are protected when not in use by a cylindrical cap allowing the user to utilize the conventional comb portion without interference from the tangs.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that in use a the hair styling comb is particularly suitable for forming cornrolls and other tightly rolled hair curls. A user simply inserts the longer tang into the hair and uses it as a pick to define a strand or portion of hair to be curled, the strand or portion of hair is then positioned between the pair of tangs and compressing ring is then slid towards the raised stops thereby bringing the two tangs together and gripping the hair therebetween. The user then twist the styling comb around and around forming the hair into a tightly rolled cornroll. After the cornroll is formed the user then slides compressor ring back to the connecting end of the tangs thereby separating the tangs and releasing the gripped hair, the tangs are then withdrawn from the formed cornroll. When not being used to form cornrolls the user would insert the pair of tangs into a protective cover and snapping the cover into place over the raised stops. The protective cover functions both as a cover for the tangs and also as a handle for comfortably gripping the comb for use.

Figure 1:
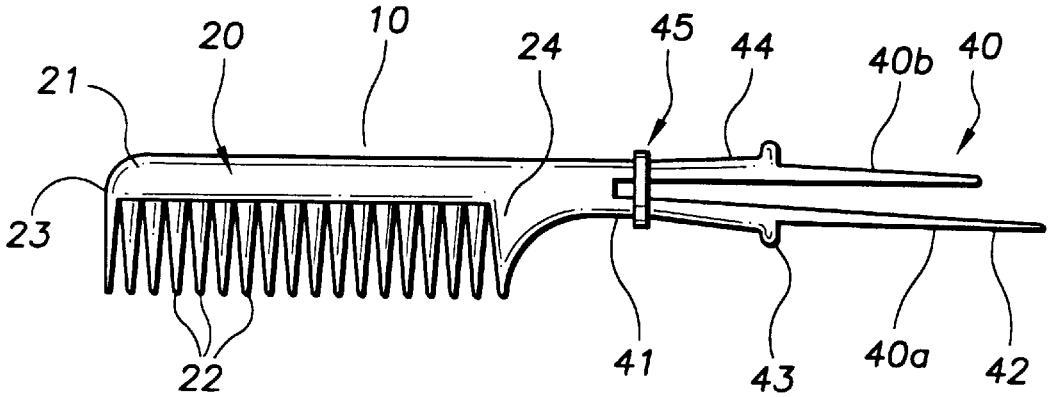
FIG. 1 is a side view of the hair styling comb with the protective cover removed from the pair of tangs and the compressor ring slid in a position towards the connecting end of the tangs so that the tangs are separated and ready inserting hair to be curled.

Referring to the figures in detail, FIG. 1 illustrates the hair styling comb 10 without the protective cover 30 attached thereto. The hair styling comb 10 includes a conventional comb assembly 20 and a pair of hair gripping tangs 40 including a longer tang 40*a* and a shorter tang 40*b*. In this embodiment longer tang 40*a* is one-half inch longer than shorter tang 40*b*. The conventional comb assembly 20 includes a comb assembly back member 21 which is substantially an elongated flat rectangular member with numerous comb tines 22 permanently attached to a long edge of the comb back assembly 21. The tines 22 are preferably formed from the same material that makes up the comb back assembly. The comb back assembly 21 includes a front end 23 and a back end 24. While a pair of tangs 40 extends from the back end 24 and preferably, like the tines, are constructed from the same material comprising the comb back assembly. If fact the comb back assembly, tines, and the pair of tangs are preferably constructed of the same continuous piece of material, which is preferably a durable plastic suitable for injection molding.

The tangs 40 extend from and are longitudinally in alignment with the comb back member. The tangs 40 have a connecting end 41 which connects the tangs to the back end of the comb back member and gripping ends 42 which are used for gripping hair placed between the tangs. The tangs are normally separated and are formed from plastic that preferably includes a memory for urging the tangs to remain on a separated position. A raised stop 43 is positioned on each tang while a tapered portion 44 on each tang is positioned between the raised stop and connecting end 41. A compressor ring 45 is positioned around the tangs on the tapered portion. When the compressor ring 45 is near the connecting end of the tangs the tangs are in the separated position, but when the compressor ring is slid up the tapered portion the tangs are brought together along with the gripping ends 42. The compressor ring 45 is preferably constructed of material which easily slides on the material comprising the tangs tapered portion. The gripping ends of the tangs may include a frictional gripping surface is desired.

Figure 3:
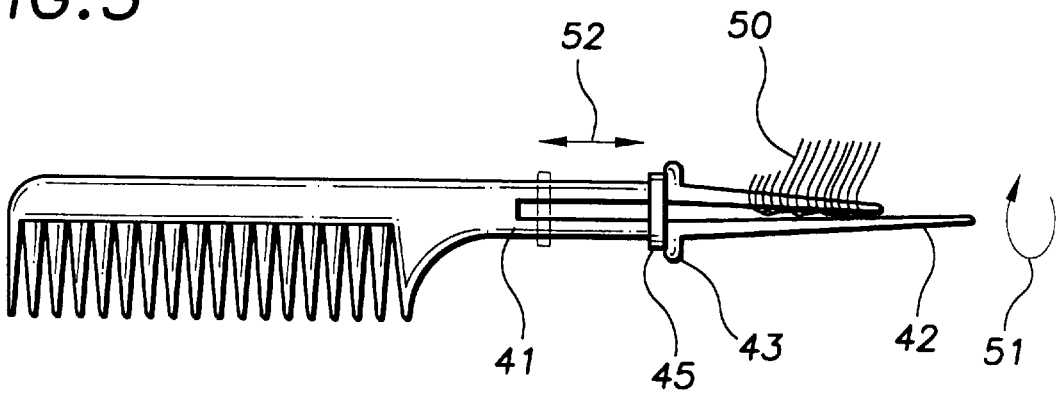
FIG. 3 is a side view of the hair styling comb with the compressor ring slid toward the raised stops on the tang thereby squeezing the tangs together and gripping hair placed between the gripping ends of the tangs.

FIG. 3 illustrates hair 50 which has been placed between the gripping ends 42 while the compressor ring 45 has been slid towards the raised stop, as indicated by arrow 52, moving the gripping ends into gripping contact. Once the hair 50 has been gripped, the user then twist the comb around and around forming the cornroll, as illustrated by arrow 51 in FIG. 3.

Figure 2:
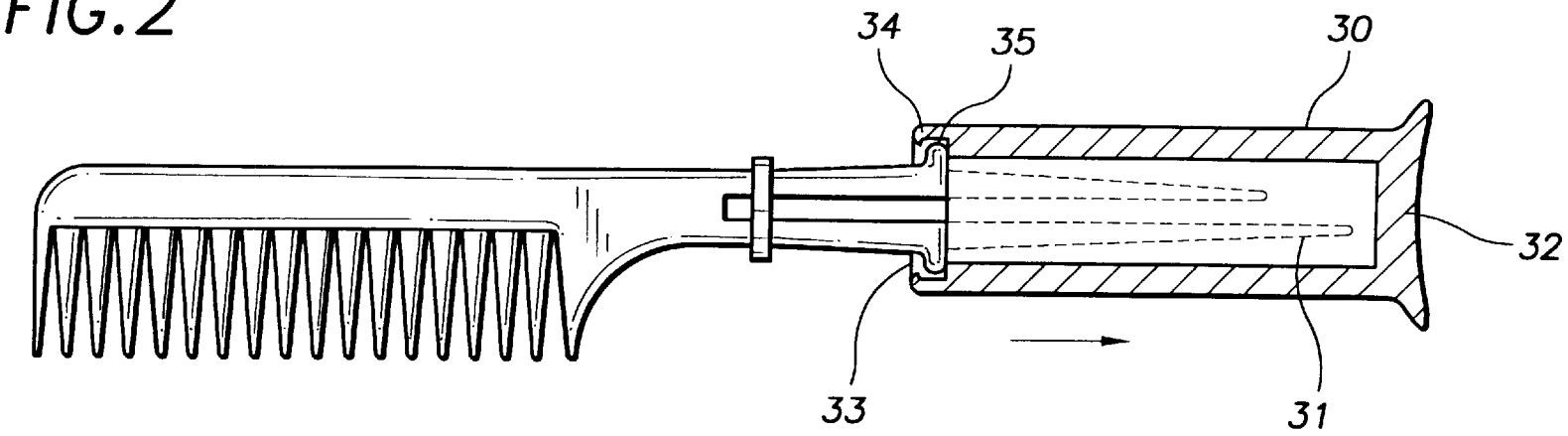
FIG. 2 is a side view of the hair styling comb with a cross sectional view of the protective cover installed on the tangs and retained in positioned over the raised stops on the tangs.
Figure 2A:
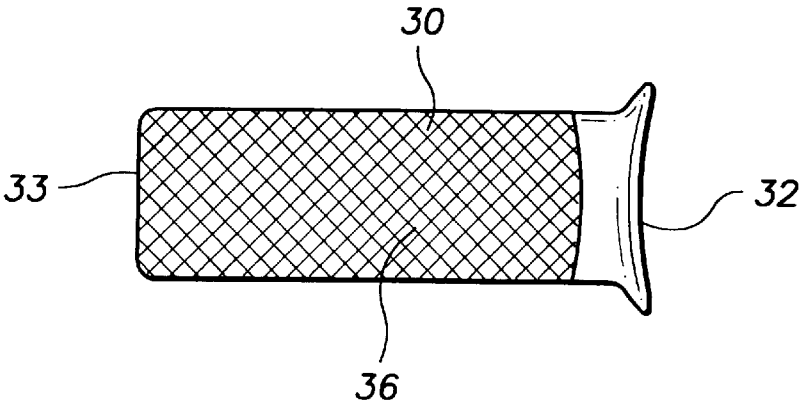
FIG. 2*a* is a side view of a protective cover removed from the hair styling comb.

FIG. 2 and FIG. 2*a* illustrate the hair styling comb with the protective cover 30 installed and separated. The protective cover 30 is cylindrical in shape and includes a hollow interior 31 for receiving the tangs 40. The protective cover also includes a capped end 32 and a open end 33 for receiving the tangs 40. The open end 33 also includes a retaining clip 34 formed around the periphery of the opening 33. The retaining clip 34 includes a recessed area 35 which mated with the raised stops 43 and retains the protective cover on the comb. The protective cover has a dual purpose, one purpose is to protect the user from the tangs when the user is using the comb end of the invention and the other purpose is to provide a comfortable grip for the user when the using the comb. The protective cover also includes a contoured surface 36 for providing sure grip for the comb.

It is noted that the embodiment of the Hair Styling Comb described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A hair styling comb, comprising:

a) a comb assembly having a plurality of fixedly secured tines arranged orthogonally to a comb assembly back member and formed continuously from material comprising the back member, the comb assembly back member has a front end and a back end, b) a pair of tangs including a longer tang and a shorter tang, the pair of tangs extending from the back end of the comb assembly back member and longitudinally to the comb assembly back member wherein said tangs have a hair gripping end where hair is gripped between the tangs when the tangs are brought together and a connecting end where the tangs are connected to the comb assembly back member, the tangs are normally separated and resist movement toward one another, the tangs include a raised stop formed in the tangs and positioned about one inch from the connecting end of the tangs, a tapered portion of the tangs extending from the raised stop to the connecting end of the tangs while a sliding compressor ring is slidingly fitted around the tapered portion of both tangs while the tapered portion is tapered so that when the compressor ring to slid to the raised stop the hair gripping ends of the tangs are urged together thereby gripping hair placed therein and when the compressor ring is slid to the connecting end of the tangs the gripping end of the tangs separates, and c) a protective cover comprising a cylindrical body with an entry end and an interior for receiving the pair of tangs and a retaining clip portion positioned on a periphery of the entry end for engaging with the raised portion of the tangs when the tangs are inserted into the protective cover.

2. The hair styling comb of claim 1, wherein said protective cover further comprises a protective cover with a capped back end and a contoured portion of said back end that provides comfortable gripping the protective cover so that the comb assembly may be effectively used without interference from the tangs.

3. The hair styling comb of claim 1, wherein the pair of tangs further comprises gripping ends with textured surfaces for gripping hair and providing frictional engagement with the gripped hair.

4. The hair styling comb of claim 1 wherein the tangs, comb assembly back member, and the tines are all formed from one continuous piece.

* * * * *